US007930864B2

(12) United States Patent
Wendt

(10) Patent No.: US 7,930,864 B2
(45) Date of Patent: Apr. 26, 2011

(54) MOUNTING CLIP

(75) Inventor: Alan C. Wendt, Barrington, IL (US)

(73) Assignee: USG Interiors, Inc., Chicago, IL (US)

( * ) Notice: Subject to any disclaimer, the term of this patent is extended or adjusted under 35 U.S.C. 154(b) by 164 days.

(21) Appl. No.: 12/369,010

(22) Filed: Feb. 11, 2009

(65) Prior Publication Data

US 2010/0199594 A1 Aug. 12, 2010

(51) Int. Cl.
*E04B 9/12* (2006.01)

(52) U.S. Cl. .... 52/712; 52/655.1; 52/506.07; 52/718.01

(58) Field of Classification Search ..... 52/506.07, 52/655.1, 665, 712, 718.01; 403/230, 353
See application file for complete search history.

(56) References Cited

U.S. PATENT DOCUMENTS

| | | | | |
|---|---|---|---|---|
| 3,798,865 | A * | 3/1974 | Curtis | 52/665 |
| 4,535,580 | A | 8/1985 | Shirey | |
| 5,195,289 | A | 3/1993 | LaLonde et al. | |
| 5,201,787 | A | 4/1993 | LaLonde et al. | |
| 5,551,792 | A * | 9/1996 | Witmyer | 403/241 |
| 5,572,844 | A * | 11/1996 | Stackenwalt et al. | 52/506.07 |
| 5,857,306 | A * | 1/1999 | Pellock | 52/643 |
| 5,937,605 | A | 8/1999 | Wendt | |
| 5,966,887 | A | 10/1999 | Mieyal | |
| 6,018,923 | A | 2/2000 | Wendt | |
| 6,018,927 | A * | 2/2000 | Major | 52/793.1 |
| 6,138,425 | A | 10/2000 | Wendt | |
| D434,304 | S | 11/2000 | Willett | |
| 6,305,139 | B1 | 10/2001 | Sauer | |
| 6,523,313 | B2 | 2/2003 | Lin et al. | |
| D472,791 | S | 4/2003 | Callahan et al. | |
| 6,729,100 | B2 | 5/2004 | Koski et al. | |
| 6,957,517 | B2 * | 10/2005 | Auriemma | 52/506.07 |
| 7,552,567 | B2 | 6/2009 | Ingratta et al. | |
| D612,224 | S * | 3/2010 | Wendt | D8/354 |
| 7,788,875 | B2 * | 9/2010 | Wendt | 52/712 |
| 2007/0113513 | A1 | 5/2007 | Wendt | |

FOREIGN PATENT DOCUMENTS

| | | | |
|---|---|---|---|
| JP | 2002-276068 | A | 9/2002 |
| KR | 10-0583675 | B1 | 5/2006 |
| WO | 2008/035921 | A1 | 3/2008 |

OTHER PUBLICATIONS

Notification of Transmittal of The International Search Report and the Written Opinion of the International Searching Authority, or the Declaration, Written Opinion and International Search Report mailed Aug. 20, 2010, International Application No. PCT/US2010/022957, International File Date: Feb. 3, 2010.

* cited by examiner

*Primary Examiner* — Robert J Canfield
(74) *Attorney, Agent, or Firm* — Pearne & Gordon LLP

(57) ABSTRACT

An L-shaped clip for mounting a trim member along an exposed edge of a suspension ceiling includes a support leg to be longitudinally secured to a grid tee and a perpendicular face leg to be secured to the trim member. The support leg includes offset clip walls for engagement with offset tee walls and clip abutment surfaces for engagement with tee abutment surfaces. The offset walls and abutment surfaces cooperate to assist in the alignment and mounting of the clip to the grid tee at different relative heights. A single clip may be mounted to either a T-shaped grid tee or an open channel grid tee.

3 Claims, 3 Drawing Sheets

MOUNTING CLIP

BACKGROUND OF THE INVENTION

This invention relates generally to suspension ceilings and more particularly to a novel and improved mounting clip or bracket for providing trim along exposed edges of such suspension ceilings.

RELATED ART

In certain applications or installations, suspension ceilings have exposed edges which require trim if a neat and finished appearance is required. For example, some suspension ceilings are provided with islands which are suspended at different levels, usually below, than the adjacent ceiling surface. Such islands have exposed edges spaced from other portions of the ceiling and walls. If such exposed edges are not trimmed in some manner, an unfinished appearance results.

In some applications, the ceiling may be terminated at a location spaced from the wall or at a location where an adjacent wall does not exist. Here again, unless a finishing trim is provided, an unfinished edge may be visible.

Exposed edges of suspension ceilings have been trimmed in a variety of manners. For example, a soffit-type stub wall may be constructed extending down to about the level of the suspension ceiling. A suspension ceiling is then installed in the typical manner extending to such stub wall. Accordingly, the soffit itself, which must be separately constructed and supported by the building structure, provides a trim for what would otherwise be an exposed edge of the suspension ceiling. In another method, a trim member which may be, for example, a channel or L-shaped member is secured to the lower face of the grid by rivets or screws. Both of these methods are labor intensive and costly. Further, in the latter method, the rivets or screws are exposed to view and detract from the finished appearance of the ceiling.

A direct mounted trim member, as shown in U.S. Pat. No. 4,744,188 assigned to the assignee of this invention, has a generally channel-shape and provides a lower leg, which fits under the flange of the grid tee. The upper leg of the channel is secured to the bulb of the grid tee. Such trim members can only be installed along exposed edges of the ceiling, where a grid tee member extends parallel to the edge and the trim member is sized to the height of the grid and exposed edge to be covered. The teachings of this patent are incorporated herein by reference.

Related U.S. Pat. Nos. 5,195,289 and 5,201,787, assigned to the assignee of this invention, disclose several trim member mounting clip systems allowing for angular mounting of the trim member relative to the main and cross grid tee directions. In one arrangement, the clip system has a U-shape support portion that snaps over the top of the grid tee bulb with a perpendicularly disposed support face for receipt of channel trim members. Another clip includes a support portion riveted to an upper surface of the grid tee for pivotal movement of a perpendicular support face connectable to a trim member. Different clips are sized for use with tee grids having different heights and configurations such as the T-shape grid tee panel and the open channel box-like support often used with rabbetted panels. Each clip is constructed for mounting to its associated grid tee at a fixed relative height and trim members are provided with visible finished surfaces extending beyond the grid tee height. The teachings of these patents are incorporated herein by reference.

It is also known to use L-shaped clips having a flat planar mounting leg that is secured to a grid tee central web or bulb.

The mounting leg extends to a right angle face portion that is attachable to a trim member. In accordance with a visual alignment determination, the installer secures the clip to the grid by screw or rivet fastening through the mounting leg at a desired position in order to fix the trim height relative to the grid and the lower ceiling surface while maintaining coverage of the exposed edge of the ceiling. Any errors in the accuracy of the visual alignment tend to be visually noticeable due to the length of the trim member. Also, the flat mounting leg has not been found to well resist twisting loads about the longitudinal axis of the grid tee resulting from the laterally extending trim member.

A variation of the latter clip includes a vertical slide that may be adjustably positioned on the face portion to vary the trim member attachment location and the relative height of the trim member and tee grid. This results in a costly multipiece clip assembly that continues to rely upon the visual alignment of the installer.

SUMMARY OF THE INVENTION

The present invention provides a novel and improved clip or bracket construction for mounting trim members or strips along exposed edges of suspension ceilings. The clip includes a support portion that connects to the grid tee and a face portion for supporting the trim member.

The support portion of the clip includes offset clip walls and abutment surfaces. The offset clip walls are arranged to engage offset grid tee walls from one side of the tee grid. As the clip is mounted to the grid, the clip offset walls are slidingly engaged with and moved along the offset tee walls to a desired upper or lower relative height position. The clip abutment surfaces engage tee abutment surfaces that limit the vertical sliding movement in the upper or lower relative height position.

The cooperating clip and tee offset walls and abutment surfaces serve to index the height position of the clip with respect to the tee grid and the interfacing ceiling tile. Therefore, the installer need not rely on visual alignment alone, but is assisted by engagement of the clip and tee walls and abutment surfaces to correctly align the members and to position the clip at the selected relative height.

The offset clip walls engage spaced grid tee walls in different pairs of locations and thereby also enhance stability of connection or mounting against twisting loads imposed around the length of the grid tee by the laterally extending trim member. In this manner, the offset clip and tee walls provide associated pairs of walls that cooperate to increase the resistance against twisting loads and distortion of the grid tee.

The clip has a generally L-shape with the support portion being provided along one leg of the L-shape and the face portion being provided along the other leg. A single clip may be used with a typical T-shape grid tee having opposed flat flanges for supporting flat panels or with an open channel grid tee having a downwardly open channel for receiving the mounting clip of a lower ceiling panel. The various grid tee styles are each commercially available with fixed vertical and lateral dimensions. For example, USG Corporation's DXT T-shape grid tee is sold under the trademark CENTRICITEE® and DXF open channel grid is sold under the trademark FINELINE® for use with its CELEBRATION® brand lower suspended metal ceiling panels and acoustical panels with rabbetted edges.

DETAILED DESCRIPTION OF THE DRAWINGS

Figure 4:
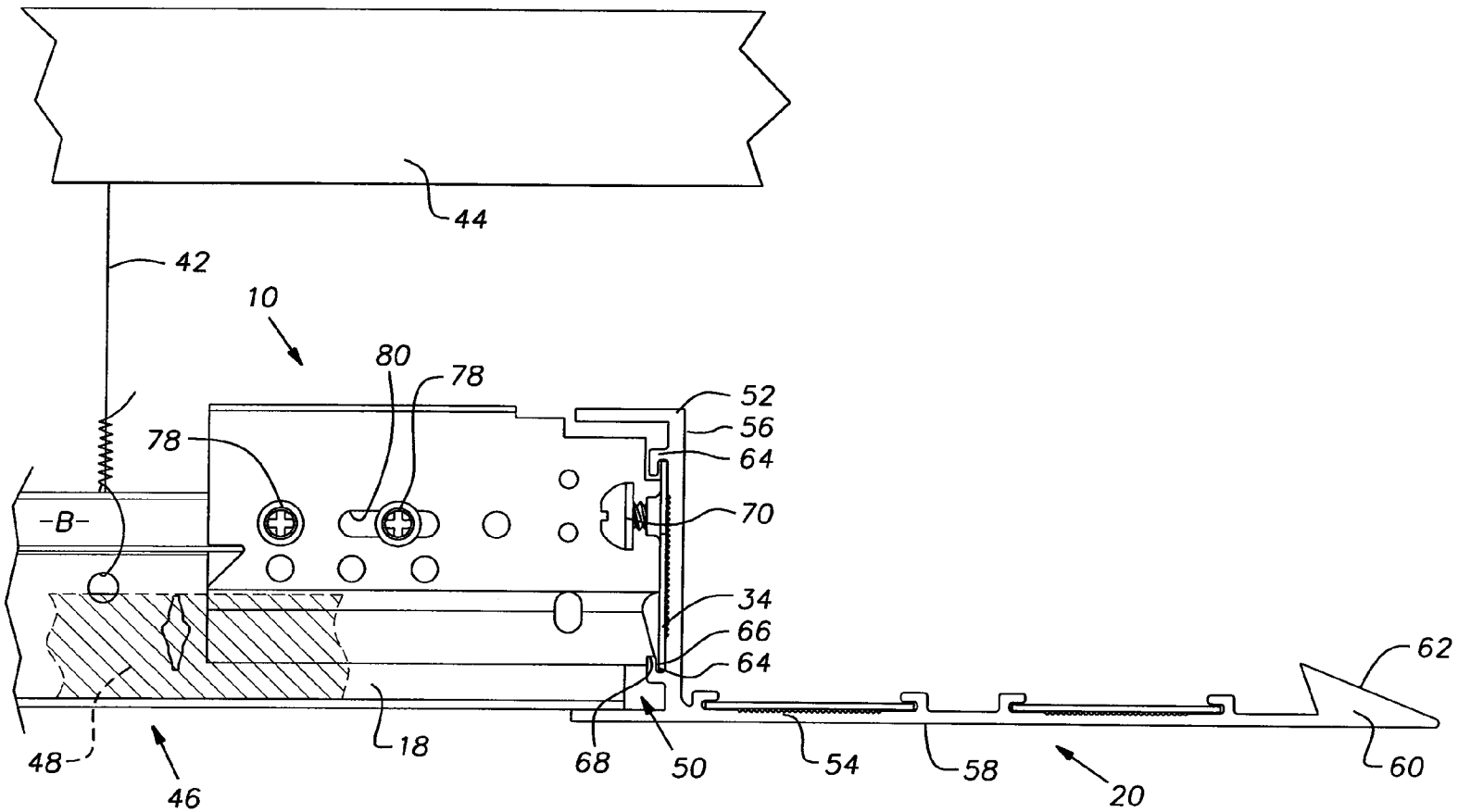
FIG. 4 is an elevational side view, partially in section, showing a suspension ceiling island having the clip mounted to a T-shape grid tee with the clip face portion connected to a trim member.

Referring to FIGS. 1 through 4, a mounting clip 10 is formed of a metal strip 12 bent into a generally L-shape to provide a support portion 14 and a perpendicular face portion 16. The support portion 14 is arranged to be aligned with and fixed to the end of a grid tee 18 with the face portion 16 extending therefrom to support a trim member 20 as shown in FIG. 4.

The support portion 14 includes offset walls or wall portions 22 and 24 joined by an angular connecting wall 26. The wall portions 22 and 24 extend in generally parallel planes. The wall portions 22 and 24 may be formed of separate members, but it is convenient in the illustrated embodiment to form spaced wall portions by bending the single metal strip 12.

The support portion 14 includes a first abutment surface 28 formed by a lower edge of the wall 24, a second abutment surface 30 formed by a metal tab 32 bent from the wall portion 22 and a third abutment surface 34 formed by an angularly disposed upper edge region of the wall portion 22. The abutment surfaces locate or fix the vertical position of the clip 10 on the grid tee 18.

Figure 1:
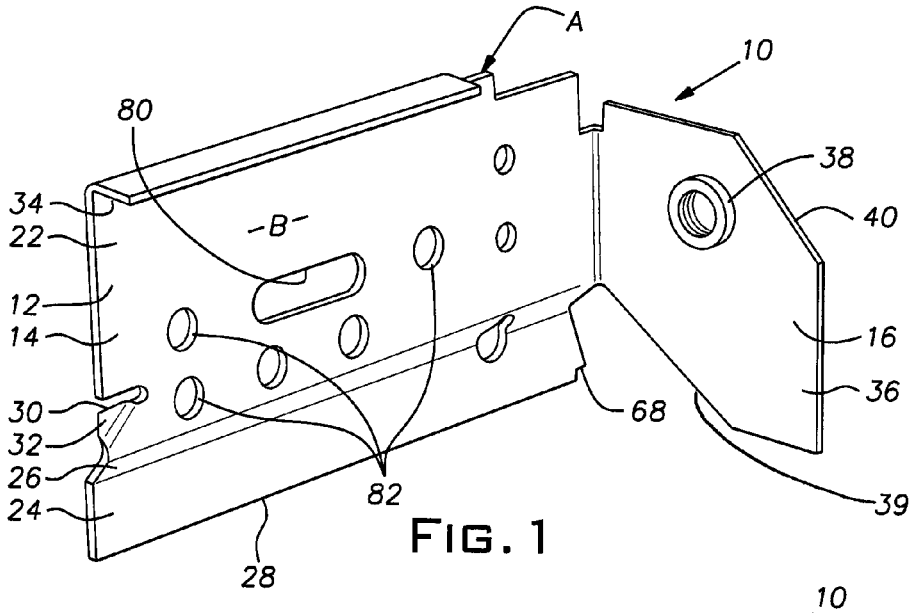
FIG. 1 is a perspective view of a mounting clip having a support portion and a face portion in accordance with the present invention.

For convenience herein, the side or surface of the clip 10 remote from the viewer as shown in FIG. 1 is designated as the "A" side and the adjacent side or surface of the clip 10 is designated as the "B" side or surface. In a similar manner, the remote side or surface of the grid tee 18 is the "A" side and the adjacent side is the "B" side. Hereafter, various elements or surfaces of the clip and the grid tee may be similarly, designated by the addition of a lowercase "a" or "b" to the part or surface reference numeral to designate one side or another.

The support portion 14 includes a generally planar wall 36 integrally formed with and rigidly extending at a right angle from the metal strip 12 forming wall portion 22. The wall 36 includes a threaded set screw hole 38 for securing the trim member 20 and a beveled corner 40 to facilitate connection to the trim member 20 as described below.

As shown in FIG. 4, the grid tee 18 is supported in a generally horizontal position by a plurality of hanger wires 42 (only one being shown) secured to a building structure (not shown) or to a primary suspension ceiling 44 which is secured to the building structure. The grid tee 18 may be a main runner or a cross runner in a plurality of interconnected grid tees forming an island suspension ceiling 46 disposed below the primary ceiling 44. The island 46 includes a plurality of ceiling panels 48, only one being shown in-part in dotted outline, supported by the grid tees.

As shown in FIG. 4, the trim member 20 has a generally L-shape cross-section and a length extending into the plane of the figure for positioning along an exposed edge 50 of the ceiling 46. More particularly, the trim member 20 includes an upright leg 52 extending at a right angle from a lateral leg 54. The upright leg 52 has a height about equal to the height of the exposed edge 50 which generally corresponds with the lower extremity of the grid tee 18 and the upper extremity of the clip 10. The lateral leg 54 extends laterally from the exposed edge 50 a sufficient distance to allow trim corners to be formed at intersecting exposed edges.

The upright leg 52 has a finished surface 56 which may be visible at least in-part from below. Similarly, the lateral leg 54 has a finished surface 58 which is visible from below and a barbed end 60 including a return surface 62 that may also be visible at least in-part from below. The finished surfaces cooperate to provide the island 46 with a finished edge that covers the exposed edge 50. The trim member may be formed as an aluminum extrusion and powder coated to provide decorative finish surfaces.

Opposed mounting arms 64 extend along a rear side of the leg 56 to form a channel 66 for receiving the wall 36 of the face portion 16 of the clip 10. The clip 10 is initially assembled to the trim member 20 by orienting it slightly counterclockwise from the showing in FIG. 3, positioning a lower beveled corner 39 of the wall 36 within the channel 66 at the lower arm 64 and then rotating the clip clockwise a limited angle to bring the beveled corner 40 of the wall into the channel 66 at the upper mounting arm 64. This motion causes a locking tooth 68 to grip the upper surface of the lower arm 64 and thereby hold the clip 10 in the orientation of FIG. 3 against counterclockwise rotation and thus capturing the face portion 16 in the channel 66. The mounted clip 10 may then be loosely secured in a desired position to the trim member by tightening a set screw 70 received within the threaded set screw hole 38 against the rear side of the leg 56. The assembled clip 10 and trim member 20 may then be mounted to the grid tee 18 as described below.

Figure 5:
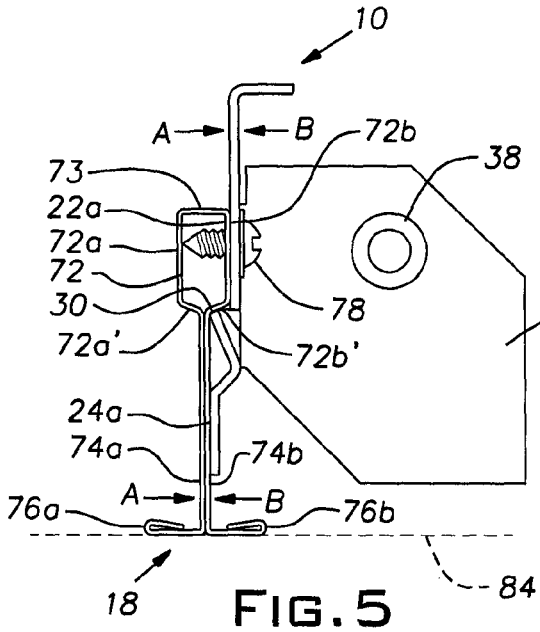
FIG. 5 is a schematic view, partially in section, showing the mounting clip in an upper position, ready to be secured to the T-shape grid tee of FIG. 4.

Referring to FIG. 5, the clip 10 installed on the grid tee 18 is schematically shown with the omission of the trim member 20. As shown, the A side of the clip 10 is mounted to the B side of the grid tee 18. As shown in FIG. 5, the grid tee 18 is bilaterally symmetrical and includes a generally rectangular closed bulb 72 having a top wall 73 extending to downwardly depending bulb sidewalls 72*a* and 72*b*. The sidewalls 72*a* and 72*b* extend to lower inclined bulb walls 72*a*' and 72*b*' that respectively join central walls 74*a* and 74*b* to form central web wall 74. At the lower edge of the central walls 74*a* and 74*b*, flanges 76*a* and 76*b* extend on the opposite sides A and B of the grid tee 18. Ceiling panels 48 are formed of compressible materials such a fiber or foam, and the panel portions adjacent the clip 10 may be compressed without loss of panel alignment and/or panel support on the flange.

In FIG. 5, the clip 10 is mounted in an upper position with the abutment surface 30 engaged with the adjacent lower bulb wall 72*b*' to fix the relative height of the clip on the grid tee. To that end, the installer may initially fix the clip 10 to the trim member 20 and slide the clip walls 22*a* and 24*a* along the grid tee walls 72*b* and 74*b* until the abutment surface 30 engages the lower bulb wall 72*b*'.

Once the clip 10 is positioned on the grid tee 18, it is fixed to the grid tee by a fastener, such as a self-tapping screw 78, extending through a slot opening 80 in the wall portion 22 as shown in FIG. 4. The slot opening 80 allows the installer to make a final longitudinal position adjustment of the clip 10 and the trim member 20 before tightening the screw 78. As shown, a second screw 78 mounted through an opening 82 may also be used to secure the clip 10 to the grid tee 18. It should be appreciated that the screw or screws 78 will draw the clip 10 and grid tee 18 together to form a rigid multiple wall assembly even if the walls or wall portions are initially slightly spaced due to lateral dimension variations or the like.

Figure 6:
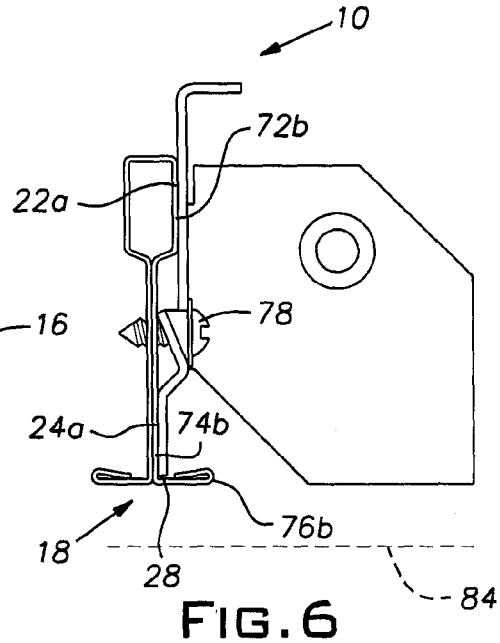
FIG. 6 is a schematic view, similar to FIG. 5, showing the mounting clip in a lower position, ready to be secured to the T-shape grid tee.

The dotted line 84 in FIGS. 5 and 6 indicates the position of the lateral leg 54 of the trim member 20 when the clip 10 is in respective upper and lower mounted positions on the grid tee 18. Referring to FIGS. 4 and 5, the leg 54 of the trim member 20 extends below and may engage the lower surface of the flange 76 of the grid tee in this mounted position.

Referring to FIG. 6, the clip 10 is shown mounted to the grid tee 18 in the lower relative height position. As shown, the A side of the clip 10 is mounted to the B side of the grid tee 18.

Once again, relative sliding movement is provided along associated wall pairs 22*a*, 72*b* and 24*a*, 74*b* during mounting. In this instance, the downward vertical travel of the clip along the surfaces of the grid tee is limited by engagement of the clip abutment surface 28 with the flange 76*b*. In this manner, combined mechanical and visual alignment of the clip on the grid tee is again achieved and the installation is completed as described above.

Figure 7:
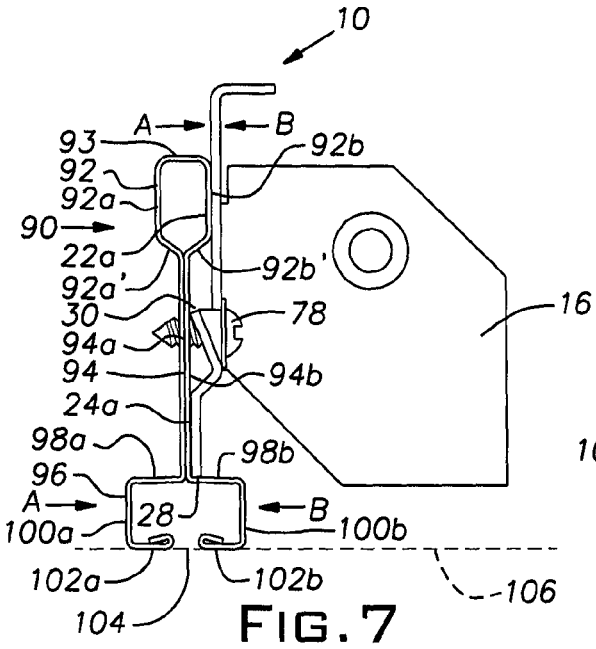
FIG. 7 is a schematic view, partially in section, showing the mounting clip in an upper position resting on the box portion of an open channel grid and ready to be secured thereto.

Referring to FIG. 7, the clip 10 is shown mounted in a relatively higher or upper position to an open channel grid tee 90. The grid tee 90 is bilaterally symmetrical and, once again, the opposed sides are referred to as "A" and "B" sides in the same manner as in the above embodiments. As shown, the A side of the clip 10 is mounted to the B side of the grid tee 18.

The grid tee 90 includes a generally rectangular top bulb 92, a central web wall 94 and an open channel 96. The bulb 92 has a generally rectangular shape including a top wall 93 extending to downwardly depending bulb sidewalls 92*a* and 92*b*. The sidewalls 92*a* and 92*b* extend to lower bulb walls 92*a*' and 92*b*' that respectively join central walls 94*a* and 94*b* to form the central web wall 94. At the lower extremities of the central walls 94*a* and 94*b*, oppositely extending channel top walls 98*a* and 98*b* cooperate to form the upper side of the open channel 96. The top walls 98*a* and 98*b* respectively extend to depending channels sidewalls 100*a* and 100*b* having inturned lips 102*a* and 102*b* that define the channel opening 104.

As shown in FIG. 7, the clip 10 is shown mounted to the grid tee 90 in the upper relative height position. Once again, relative sliding movement is provided along associated wall pairs 22*a*, 92*b* and 24*a*, 94*b*. In this instance, the downward vertical travel of the clip along the surfaces of the grid tee is limited by engagement of the clip abutment surface 28 with the channel top wall 98*b*. In addition, the abutment surface 30 engages the central wall 94*b*. Once again, the installation of the clip is facilitated by the combined mechanical and visual alignment of the clip on the grid tee. The final installation of the clip is completed as described above.

The dotted line 106 in FIG. 7 indicates the position of the lateral leg 54 of the trim member 20 when the clip 10 is in the upper mounted position on the grid tee 90. In this position, the leg 54 of the trim member 20 extends below and may engage the lower surface of the inturned lip 102*b*. This may result in a flush ceiling appearance with the use of rabbetted panels.

Figure 8:
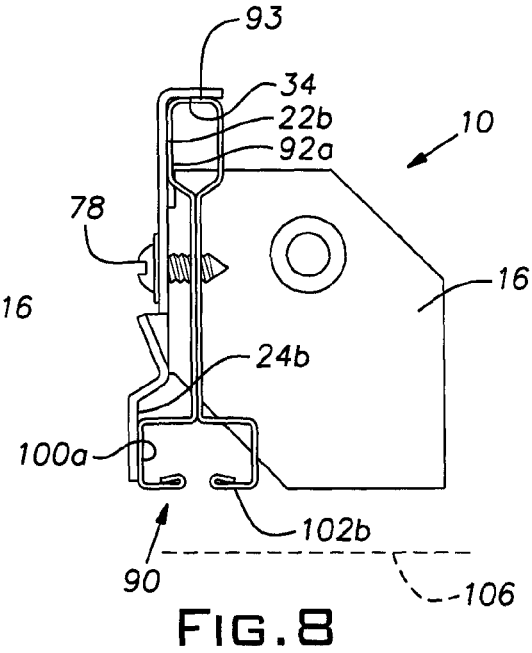
FIG. 8 is a schematic view, similar to FIG. 7, showing the mounting clip on the opposite side of the open channel grid and in the lowest position, ready to be secured thereto.

Referring to FIG. 8, the clip 10 is shown mounted in a lower relative height position on the grid tee 90. In this case, the "B" side of the clip 10 engages the "A" side of the grid tee 90. The dotted line 106 references the position of the trim member lateral leg 54.

The clip 10 is mounted to the grid tee 90 by relative sliding movement along associated wall pairs 22*b*, 92*a* and 24*b*, 100*a*. In this instance, the downward vertical travel of the clip along the surfaces of the grid tee is limited by engagement of the clip abutment surface 34 with the bulb top wall 93. As in the above embodiments, the installation of the clip is facilitated by the combined mechanical and visual alignment of the clip on the grid tee. The final installation of the clip is completed as described above.

The mounting of the clip in the lower position on the grid tee 90 results in the trim member leg 54 extending below the inturned lip 102*b* and substantially aligned with the lower ceiling surface in the case of rabbetted panels.

Figure 2:
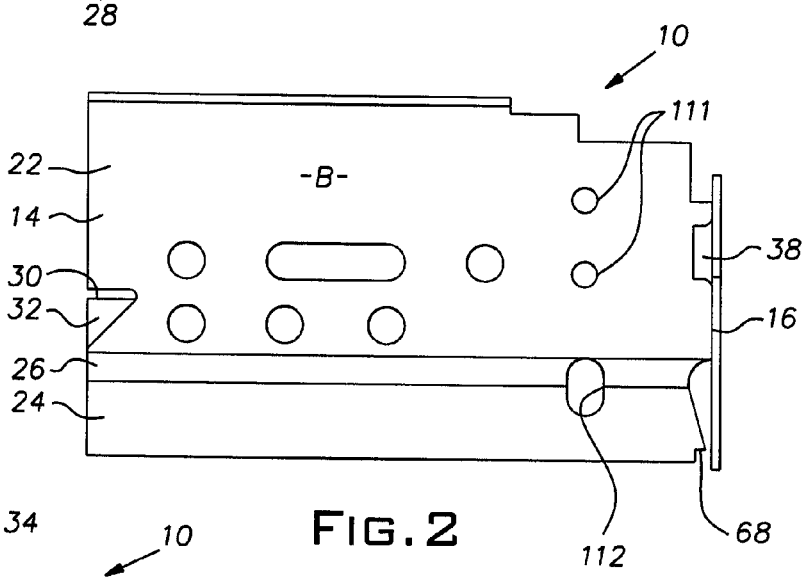
FIG. 2 is an elevational side view of the clip particularly showing a plan view of the support portion and an edge view of the face portion.
Figure 3:
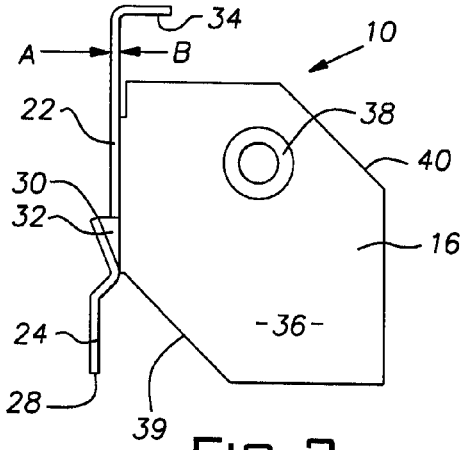
FIG. 3 is an elevational end view of the clip particularly showing a plan view of the face portion thereof and an edge view of the support portion.

With reference to FIGS. 1 and 2, a set of vertically aligned apertures in the form of round holes 111 and a vertical oriented oblong slot 112 make a potential bend line in the support portion 14. A pair of snips can be used to cut through the body of the support portion 14 below the slot 112. Once this cut is made, the support portion 14 can be bent along the line of the apertures 111, 112 to mount the trim member 20 at an angle to a grid tee 18 or 90 in the horizontal plane of the ceiling.

The section of the support portion 14 between the face portion 16 and the bend line of the apertures 111, 112 can remain perpendicular to the face portion, and therefore the trim member 20, so that the hook portion 68 retains its anti-rotation function.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed:

1. A suspension ceiling trim mounting clip for mounting trim members on a grid tee member having opposed sides, tee walls engageable from said opposed sides, and a length adapted to extend to an exposed edge of a suspension ceiling grid formed of interconnected grid tee members, said clip including a support portion for engaging said grid tee member and a face portion for connecting a trim member to said clip, the face portion being in a plane generally perpendicular to a plane in which said support portion exists, said face portion being receivable in a channel formed between upper and lower opposed arms on the trim member, the face portion having a profile permitting it to be assembled into the channel when rotated about a horizontal axis through a limited angle and causing it to be retained in the channel when rotated to an upright position and a locking tooth on said support portion engageable with one of said arms when said clip is rotated to the upright position to prevent reverse rotation of said face portion in said channel from said upright position to said temporary orientation.

2. The mounting clip of claim 1, wherein the face portion carries a set screw operable to secure the clip at a desired position with the trim member.

3. The mounting clip of claim 1, wherein said support portion has a provisional bend zone formed by a weakened line, the bend zone permitting a section of the support portion remote from the face portion to be bent to an angle with respect to the face portion different than 90°.

* * * * *